United States Patent [19]

Deiner

[11] 4,211,815

[45] Jul. 8, 1980

[54] WATERPROOFING OF TEXTILES

[75] Inventor: Hans Deiner, Hainhofen, Fed. Rep. of Germany

[73] Assignee: Ciba-Geigy Corporation, Ardsley, N.Y.

[21] Appl. No.: 526,779

[22] Filed: Nov. 25, 1974

[30] Foreign Application Priority Data

Dec. 1, 1973 [DE] Fed. Rep. of Germany ..... 2359966

[51] Int. Cl.[2] ..... B32B 27/12

[52] U.S. Cl. ..... 428/290; 427/369; 427/387; 427/393.4; 427/439; 428/262; 428/266; 428/447; 428/452; 428/500; 428/507

[58] Field of Search ..... 427/394, 387, 439, 390 E, 427/369; 428/447, 452, 507, 500, 266, 262, 290

[56] References Cited

U.S. PATENT DOCUMENTS

| | | | |
|---|---|---|---|
| 2,854,424 | 9/1958 | Solomon et al. | 427/390 E |
| 3,245,831 | 4/1966 | Shippee | 427/390 R |
| 3,401,006 | 9/1968 | Perrino | 427/390 C |
| 3,442,694 | 5/1969 | Sookne et al. | 427/390 R |
| 3,476,532 | 11/1969 | Hartman | 427/390 E |
| 3,619,278 | 11/1971 | Ogawa | 427/439 |
| 3,637,427 | 1/1972 | Tsuruta et al. | 427/387 |
| 3,810,775 | 5/1974 | Uhl et al. . | |

*Primary Examiner*—Ronald H. Smith
*Assistant Examiner*—Janyce A. Bell
*Attorney, Agent, or Firm*—Edward McC. Roberts

[57] ABSTRACT

This invention relates to the treatment of fibrous materials such as textiles to make them water-repellent. It has been found that the amount of organopolysiloxane used in treatment baths for those purposes can be considerably reduced by replacing up to 70% by weight of the emulsified organopolysiloxane with 30 to 65% by weight of the replaced organopolysiloxane of an emulsified oxidized polyethylene. Even though oxidized polyethylene does not by itself impart water-repellent properties to textiles its combination with the organopolysiloxane does give treated fabrics with excellent water-repellent properties.

8 Claims, No Drawings

WATERPROOFING OF TEXTILES

This invention relates to a process for the water-repellent finishing of fibrous materials of all types and to compositions which are capable of imparting a water-repellent finish to fibre materials.

BACKGROUND OF THE INVENTION

All types of fibre materials can be made water-repellent by the use of emulsified organopolysiloxanes, especially organohydrogenpolysiloxanes, that is organopolysiloxanes which contain hydrogen atoms bonded to silicon atoms. Suitable emulsifiers for use in such cases are both non-ionic substances, such as ethylene oxide adducts of alkyl phenols, fatty acids, fatty alcohols, fatty acid amides and fatty amines or polyvinyl alcohols and cationic products, such as quaternary ammonium compounds, e.g. octadecyl oxymethyl pyridinium chloride or cetyl benzyl dimethyl ammonium chloride (see German Pat. No. 1,060,347, U.S. Pat. No. 3,748,275 and British Patent Specification No. 1,300,250). Also, epoxy condensation products can be used for emulsifying organopolysiloxanes (see U.S. Pat. No. 3,320,197 and U.S. Pat. No. 3,729,437). One particular property of the fibrous materials treated with silicones is that they have a specific, soft "silicone handle" in addition to very good water-repellent properties.

The finishing of the fibrous materials is generally carried out with aqueous liquors which contain approximately 40 to 70 g/l of the approximately 35% polysiloxane emulsions and optionally, depending on the emulsifiers which are used, suitable hardening catalysts, the fibrous material taking up about 50 to 75% of the finishing solution.

The technological properties, for example the tensile strength, the handle and the lustre of woven fabrics, can be improved by treatment with aqueous emulsions of oxidised polyethylenes (see for example U.S. Pat. No. 3,475,207). However, the treatment with these oxidised polyethylenes does not impart any water-repellent properties to the treated materials; to the contrary, if anything, a deterioration in the water-repelling properties is to be expected.

However, it has now surprisingly been found that liquors with substantially smaller quantities of organopolysiloxanes can be used in the water-repellent treatment of fibrous materials with aqueous silicone emulsions if these organopolysiloxanes are used together with an emulsified oxidised polyethylene wax, without causing any deterioration in the water-repellent effects and the typical silicone handle.

BRIEF SUMMARY OF THE INVENTION

The process according to the invention for providing fibrous materials with a water-repellent finish with an aqueous liquor containing an emulsion of an organopolysiloxane which contains hydrogen atoms bonded to silicon, comprises replacing up to 70% of the emulsified polysiloxane, calculated as a solid, present in the treatment liquors prepared in the known manner, by an emulsified, oxidised polyethylene which is emulsified in the conventional manner with a non-ionic and/or a cationic emulsifier, whereby only about 30 to 65 precent by weight of the oxidised polyethylene, referred to the replaced organopolysiloxane solid, is used.

The organopolysiloxane emulsion and the polyethylene emulsion can be stored separately and be mixed together immediately prior to use. Alternatively the mixed siloxane and oxidised polyethylene emulsions can be stored together indefinitely, preferably followed by brief mixing immediately before use.

The invention therefore also provides compositions for rendering fibrous materials water-repellent, said compositions containing an aqueous emulsion of an organopolysiloxane which has been emulsified with a non-ionic and/or a cationic emulsifier and which contains hydrogen atoms bonded to silicon, and an aqueous emulsion of an oxidised polyethylene emulsified in the conventional manner with a non-ionic and/or a cationic emulsifier, said emulsions containing per 100 parts of organopolysiloxane, calculated as a solid, 3 to 152 parts, preferably 7.5 to 100 parts of oxidised polyethylene, also calculated as a solid.

These compositions are advantageous with respect to their stability during storage and transport and also in applying them to fibrous materials.

Oxidised ethylene homopolymers or copolymers which can be used are ethylene and other $\alpha$-olefines having a density of from about 0.91 to 1.05 g/cc, and more particularly a density of from 0.93 to 0.99 g/cc. The acid number of these oxidised polyethylene polymers is between approximately 7 and 115, and more particularly between 10 and 60. One can employ the ethylene homopolymers or copolymers which contain, as well as ethylene, other $\alpha$-olefines, wuch as propylene, 1-butene, 1-pentene and 3-methyl-1-butene. By "polyethylene", therefore, we intend to embrace both the homopolymer and copolymers.

The polyethylene can be emulsified in known manner. The general procedure is for the emulsifier to be dissolved in water and for the solution which is obtained to be heated to 50° to 70° C. A polyethylene wax solution in an organic, water-insoluble solvent, such as toluene, petroleumethers with a boiling range from about 80° to 180° C., tri-chlorethylene, tetrachlorethylene or halogenated benzene, particularly chlorinated benzene, is prepared at about 80° to 100° C., and is stirred into the aqueous emulsifier solution with the aid of a high-speed stirrer. The pre-emulsion which is thus obtained is subsequently homogenised at about 50° to 70° C. with a high-pressure emulsifier machine at about 200 to 300 atm. Depending on circumstances, it is also possible for the pre-emulsion to be cooled to room temperature before the high-pressure homogenisation.

For the preparation of the polyethylene emulsion and particularly when using ethyoxylated fatty acid amines as emulsifier, the procedure adopted can also be for the oxidised polyethylene to be melted together with the emulsifier and for the finished emulsion to be formed by simple dilution with hot water. A high-pressure homogenisation is not necessary in this case.

The polyethylene emulsions which are obtained contain about 10 to 20% of oxidised polyethylene. Generally 10 to 40% of emulsifier will be introduced, calculated on the weigth of the oxidised polyethylene.

The organopolysiloxanes which are used in the process of the invention contain hydrogen bonded to silicon. Example of such organopolysiloxanes are alkyl hydrogen polysiloxanes, more especially lower alkyl hydrogen polysiloxanes such as the preferred methyl and ethyl hydrogen polysiloxanes. The alkyl hydrogen polysiloxanes may possibly also be mixed with organopolysiloxanes which do not contain any hydrogen bonded to silicon, such as dimethyl or diethyl polysiloxanes, it being entirely possible for these organopolysiloxanes to be preponderant. It is also possible to replace these mixtures by suitable co-hydrolysates of silanes, that is to say, of the preparation of the organopolysiloxanes, jointly to hydrolyse silanes which contain hydrogen atoms bonded to silicon with those silanes which do not contain any hydrogen atoms bonded to silicon and to emulsify to co-hydrolysates which are thus obtained. The advantages of the invention are particularly evident when the molar proportion of alkyl hydrogen polysiloxane predominates over any dialkyl polysiloxane present or when pure alkyl hydrogen polysiloxane is used.

The emulsification of the organopolysiloxanes can be effected to known manner. The usual procedure is for a solution of the polysiloxane in the water-insoluble solvent, examples of which have been referred to above, to be stirred into an aqueous solution of the emulsifier. The pre-emulsion which is thus obtained is possibly diluted, adjusted to the required pH and homogenised under high pressure.

In this manner, approximately 20 to 40% organopolysiloxane emulsions are obtained. The amount of emulsifier amounts on average to 8 to 35%, based on the emulsified organopolysiloxane. The preparation of organopolysiloxane emulsions is known and by way of example, reference is made to German Pat. No. 1,060,347 and U.S. Pat. Nos. 3,320,197, 3,729,437, 3,748,275.

Non-ionic and preferably cationic emulsifiers are suitable as emulsifiers for emulsifying the oxidised polyethylene and the organohydrogen polysiloxane. Suitable emulsifiers are known per se. Non-ionic substances, are e.g. ethylene oxide adducts of alkylphenols, fatty acids, fatty alcohols, fatty acid amides and fatty amines (see U.S. Pat. No. 3,748,275). The fatty acid amides and fatty amines can be converted into salts by reaction with acids (e.g. low organic acids and mineral acids), and ethoxylated fatty amines and their salts, are prefered. Cationic products, such as quaternary ammonium compounds, e.g. octadecyl oxymethyl pryridinium chloride or cetyl benzyl dimethyl ammonium chloride (see French Pat. No. 1,570,231 or British Patent Specification No. 1,300,250) can also be employed. In addition, also other cationic condensation products, such as epoxy condensation products, are suitable emulsifiers for the oxidised polyethylenes and organohydrogen polysiloxanes (see for example U.S. Pat. Nos. 3,320,197 and 3,729,437).

The emulsions as thus prepared from organopolysiloxanes and polyethylene are used according to the invention for imparting water-repellency to fibre materials of all types. However, whereas 40 to 70 g/l of an approximately 30 to 35% polysiloxane emulsion would previously have been used in the bath for giving the required water-repellency, with a liquor take-up of 50 to 75% on the fibre material, bath solutions containing about 15 to 35 g/l of a 30 to 35% polysiloxane emulsion and additionally about 20 to 50 g/l of a 10 to 20% polyethylene emulsion have been found to be sufficient according to the invention for finishing fibrous materials and to render them water-repellent. Whe starting with concentrated emulsions they are diluted to such a degree prior to use that the resulting mixed emulsions give a bath solution containing the required amounts of siloxane and oxidised polyethylene.

The treatment bath solution can if required contain, in addition to the polysiloxane and the oxidised polyethylene, a catalyst for the complete hardening or curing of the organopolysiloxane. Known compounds can be used as such catalysts and examples are alkyl tin compounds, such as dialkyl tin dilaurate, or basic zirconium salts, and the condensation products described in U.S. Pat. Nos. 3,320,197 and 3,725,502. Other hardening agents can be employed, see for example U.S. Pat. No. 3,622,546. The catalyst is preferably used in a quantity of 5 to 15% of the organopolysiloxane. The hardening catalyst can either be added directly to the bath solution or it can also be incorporated from the outset into the polyethylene emulsion.

The water-repellent finishing can be carried out in known manner. For this purpose, the fabrics can for example be impregnated with the bath solution prepared as described above, squeezed out to 50 to 75% weight increase, dried for 10 minutes at about 100° to 120° C. and finally condensed for a few minutes at about 140° to 170° C.

Using the process according to the invention, fibrous materials of all types can be rendered water-repellent. In particular the fibrous materials are textiles which can be treated according to the invention, and the textiles which are particularly suitable are those which consist at least in part of cellulose fibres. As mixed fibres, there are to be considered both man-made fibres, such as polyester, polyamide or polyacrylonitrile fibres, as well as wool. However, the process according to the invention can also be carried out on purely man-made fibre materials.

The water-repellent finish can be combined with other finishing methods for improving the properties of fibre materials. Particularly to be considered is a combination with crease-proofing agents, filler resins and flame-proofing agents as well as the catalysts belonging thereto.

The process according to the invention shows a surprising technical advance which was not to be expected. It is in fact possible with this process and without any deleterious action on the water-repellent effects to save a considerable part, namely up to 70%, advantageously 10 to 70%, and more particularly 20 to 60%, of the organo-polysiloxanes which would be needed without the presence of the oxidised polyethylene. The oxidised polyethylene which is used in place of the organopolysiloxanes is used in a smaller quantity by weight relatively to solids, i.e. only up to about 30 to 65% by weight. It must be surprising that there is practically no lowering of the water-repellent effects, despite the replacement of a large proportion of the organopolysiloxane by oxidised polyethylene, although when oxidised polyethylene is used alone, it is necessary to accept to some extent a deterioration in the water-repellent finish. The process according to the invention therefore shows in a surprising manner a simple procedure for achieving a very good hydrophobic finish with a considerable reduction in the quantity of organopolysiloxane used. When it is considered that oxidised polyethylene, by itself does not have any hydrophobic action and is used in a smaller quantity than the polysiloxane which is replaced thereby, there appears to be a surprising synergistic effect with the process according to the invention. Oddly enough, this synergism does not occur when paraffin is used instead of polyethylene.

The invention will now be illustrated by the following Examples.

EXAMPLE 1

Emulsion A 160 g of an aqueous solution, the production of which will be described hereinafter, are stirred in with a solution of 128 gr of a low polymer hydrogenpolysiloxane, which at 20° C. has a viscocity of 50 cp, in 122 g perchloroethylene. This pre-emulsion is thereupon diluted with a solution of 6 g of a 60% acetic acid in 240 ml water and then the whole is homogenized. Then a very fine-particled opalescent emulsion is produced which is very liquid and has a pH of 4.2. It can be stored unchanged for at least one half year.

The above mentioned aqueous solution is produced by heating for 40 minutes to 40° C. to 50° C. a glycidyl ether of 4,4'-dioxydiphenyl-2,2'-propane with 0.43% epoxy groups with 20 gr of 85% ethylene diamine in 160 ml methanol on a reflux condenser, followed by adding a 10% acetic acid until the pH value is 5.

Emulsion B

For emulsifying 100 g of polyethylene wax (acid number 25 density at 20° C., 0.95 g/cc), the wax was dissolved in 200 g of trichlorethylene and 450 g of a solution used for emulsification prepared according to Example 1, paragraph 2, of U.S. Pat. No. 3,320,197 were stirred in at 60° C. and thereafter cooled. The solution used for emulsification can be produced by heating for about 40 minutes 100 gr of a glycidyl ether of 4,4'-dioxydiphenylpropane (epoxide number 0.43) with 20 g ethylene diamine (80%) in 160 ml methanol to 40° C. to 50° C., whereupon is added a mixture of 620 ml of water and 100 g of a 60% acetic acid. Then 20 g of dibutyl tin dilaurate were added, as catalyst for the organopolysiloxane. The mixture was thereafter homogenised at 250 atm for 45 minutes in a high-pressure homogenising machine and finally also 230 g of water were introduced. In the same way, it is also possible to emulsify an oxidised polyethylene with an acid number 14 and a density of 0.925 g/cc.

Emulsion C

For comparison purposes, an emulsion corresponding to the Emulsion B was prepared, but containing 15% paraffin (melting point 52° to 54° C.) instead of the oxidised polyethylene.

For finishing a cotton poplin (weight per square meter about 170 g) the following bath solutions were prepared:

Solution A1

25 g/l of emulsion A and 25 g/l of emulsion B.

Solution A2

25 g/l of emulsion A, 25 g/l of emulsion B, 30 g/l of synthetic resin (70% mixture of hexamethylol melamine etherified with $CH_3OH$ and dimethylol urea etherified with $CH_3OH$, in the ratio by weight of 3:1) and 5 g/l of 50% zinc nitrate solution.

Solution B1

50 g/l of emulsion A and 2 g/l of dibutyl tin dilaurate emulsion (20% dibutyl tin dilaurate emulsion, 2% octa decyl oxymethyl pyridinium chloride as emulsifier, 16% of tetrachlorethylene as solvent, remainder water).

Solution B2

50 g/l of emulsion A, 2 g/l of dibutyl tin dilaurate emulsion (as above), 30 g/l of synthetic resin (as above) and 5 g/l of 50% zinc nitrate solution.

Solution C1

25 g/l of emulsion A and 25 g/l of emulsion C.

Solution C2

25 g/l of emulsion A, 25 g/l of emulsion C, 30 g/l of synthetic resin (as above) and 5 g/l of 50% zinc nitrate solution.

Samples of the cotton poplin fabric were impregnated with these various bath solutions, squeezed out to 68% weight increase, dried at 100° C. for 10 minutes and condensed at 140° C. for 5 minutes.

The water-repelling effects obtained are measured according to DIN 53 888 and are listed in the following table.

| Solution | Water absorption (%) | Water repellent effect | Percentage of replaced organopolysiloxane |
|---|---|---|---|
| A1 (according to the invention) | 10 | 4<br>4<br>4 | 50 |
| A2 (according to the invention) | 8 | 4<br>4<br>4 | 50 |
| B1 (according to prior art) | 11 | 4<br>4<br>4 | — |
| B2 (according to prior art) | 7 | 4<br>4<br>4 | — |
| C1 (Control) | 23 | 3<br>2<br>2 | 50 |
| C2 (Control) | 21 | 2<br>2<br>1 | 50 |

As shown by the results in the above Table, substantially the same properties are surprisingly given to fabrics by compositions in accordance with the invention as compared with those which are obtained when using only a substantially larger quantity of organopolysiloxane emulsion. As compared with the partial replacement of the polysiloxane by paraffin, instead of polyethylene, substantially better water-repellent effects are produced when using the process according to the invention.

EXAMPLE 2

Emulsion A

An organopolysiloxane emulsion was prepared according to Example 1 A of U.S. Pat. No. 3,748,275:

25 g of the following emulsifier are dissolved in 325 ml of water

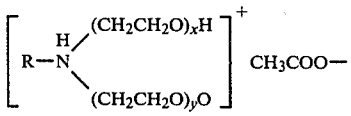

(R=16 C-atoms on the average; x+y=10) After the addition of about 2 ml concentrated muriatic acid, a mixture consisting of 240 g methyl hydrogenpolysiloxane (specific weight 0.99 to 1.01, viscosity 20 to 30 cp, 96 to 98% $SiO_2$), 60 g dimethyl polysiloxane (specific weight 0.97, viscosity at 25° C. 750 cst.) 12 g perchlorethylene, 38 g toluol is turbined in a thin jet. Then the emulsion is homogenized at 20° C. and 250 at over p. in a high pressure homogenizing machine. After termination of homogenization 200 ml water are also added and the pH value is set to 2.2 with muriatic acid.

Emulsion B

This emulsion was prepared in the manner similar to emulsion B in Example L, except that 120 g of polyethylene (acid number 45, density at 20° C., 0.98 g/cc) dissolved in 250 g of tetrachlorethylene and 350 g of the solution prepared according to Example 4 of U.S. Pat. No. 3,725,502 were contained in 1000 g of emulsion. The said solution is obtained from 300 g of a glycidyl ether of ethylene glycol having an epoxy number of 0.57, 190 g of 45 benzoguanamine and 59.5 g of N-methyldiethanolamine are boiled under reflux in the presence of 160 g of propanol and, after a pronounced increase of the viscosity, the reaction is terminated by the addition of formic acid and water. As a result, a 10 percent opalescent solution is obtained having a pH of 4.8.

For finishing a cotton poplin as referred to in Example 1 the following finishing solutions were prepared:

Solution A 20 g/l of emulsion A, 30 g/l of emulsion B and 8 g/l of, as catalyst, a basic zirconium soap containing per gram.atom of zirconium, 1 mole of lauric acid and 1 mole of a synthetic fatty acid having on average 10 carbon atoms with 10% secondary acid fraction and 90% tertiary acid fraction, as well as a saponification number of 300).

Solution A1

As solution A, but additionally containing 30 g/l of synthetic resin (composition as in Example 1) and 5 g/l of 50% zinc nitrate solution.

Solution B 30 g/l of emulsion A, 20 g/l of emulsion B and 8 g/l of the basic zirconium soap as catalyst.

Solution B1

As solution B, but additionally containing 30 g/l of synthetic resin (composition as in Example 1) and 5 g/l of 50% zinc nitrate solution. Samples of cotton poplin fabric were treated as described in Example 1 and the water-repellent effect if the finishes obtained were established according to DIN 53 886. The results are set out in the following Table.

| Solution | Water absorption (%) | Water repellent effect |
|---|---|---|
| A | 18 | 4 |
| | | 3 |
| | | 2 |
| A1 | 8 | 4 |
| | | 4 |
| | | 4 |
| B | 13 | 4 |
| | | 4 |
| | | 3 |
| B1 | 8 | 5 |
| | | 5 |

-continued

| Solution | Water absorption (%) | Water repellent effect |
|---|---|---|
| | | 5 |

EXAMPLE 3

Emulsion A

An organopolysiloxane emulsion was prepared according to Example 1 of U.S. Pat. No. 3,729,437. A solution of 128 g of a methyl hydrogen polysiloxane (viscosity at 20° C.; 50 cp) in 122 g of perchloroethylene is stirred into 160 g of an aqueous solution, the production of which will be described below. Thereafter this preliminary emulsion is diluted with 340 ml of water, the pH thereof is adjusted to 2.2 with hydrochloric acid, and the entire mixture is homogenized. During this process, a very finely divided, thinly fluid opalescent emulsion is obtained which can be stored unchanged over a period of more than 6 months.

The above-mentioned aqueous solution is prepared by heating under reflux and under agitation 35 g of a 4,4'-dihydroxydiphenylpropane glycidyl ether (epoxy number 0.44) 4 g of cyanamide, 15 g of triethanolamine, and 12 g of isobutanol, for 35 minutes. Thereafter, the reaction is stopped by the addition of a mixture of 20 g of 60 percent acetic acid and 450 g of water, and a clear to opalescent solution, pH=4.4, is obtained.

Emulsion B

A polyethylene wax emulsion was prepared as follows:

200 g of an oxidised polyethylene (acid number 65, density 1.0 g/cc) were melted at 110° C. and 40 g of an ethoxylated stearyl amine (8 ethoxy groups), to which has been previously added 1 ml of glacial acetic acid, were introduced. 240 g of water at 95° C. were then stirred in and the mixture finally diluted with 520 g of water at about 80° C. with moderate stirring, followed by cooling. This emulsion was throughly mixed with 1000 g of the condensate solution prepared according to Example 2, paragraph 2, of U.S. Pat. No. 3,729,437 and 200 g of a cationic 20% dibutyl tin dilaurate emulsion (2% of octadecyl oxymethyl pyridinium chloride as emulsifier, 16% of tetrachlorethylene as solvent, remainder water).

The aqueous preliminary condensate solution employed is produced by heating, in a 500 ml three-necked flask, with agitation, 60 g of a diglycidyl ether of polyethylene glycol 200,4 g of cyanamide, 16.4 g of diethanolisopropanolamine, and 12 g of n-butanol, to 120° C. and, after obtaining a clear, strongly viscous mixture, diluting same by the addition of acetic acid and water to a 14 percent solution having a pH of 4.5.

It is also found that polyethylene with an acid number 88 and density of 1.01 g/cc could also be emulsified in like manner.

Using these emulsions, a bath solution containing 35 g/l of emulsion A, 20 g/l of emulsion B and 2 g/l of 60% acetic acid was prepared for the finishing of a polyester fabric (weight per square meter about 260 g) and a cotton fabric (Weight per square meter about 160 g).

The results after a normal finishing are contained in the following Table.

| Fabric | Water absorption (%) | Water repellent effect |
|---|---|---|
| Polyester | 4 | 4 |
| | | 4 |
| | | 4 |
| Cotton | 13 | 4 |
| | | 4 |
| | | 4 |

Similarly good effects were obtained by using a solution of 35 g/l of emulsion A and only 16 g/l of emulsion B.

EXAMPLE 4

Emulsion A

A hydrogen polysiloxane emulsion was prepared according to Example 1 British Patent Specification No. 1,300,250.

To 380 g of a mixture of 4 parts by weight of methyl hydrogen polysiloxane and 1 part by weight of dimethyl polysiloxane (viscosity of the mixture 150 cP at 20° C.) were added 10 parts of tetrachlorethylene. The solution thus obtained was added while stirring vigorously to a solution of 15 g of technical octadecyloxymethyl pyridinium chloride (mixture of hexadecyl- and octadecyloxymethyl pyridinium chloride) in 300 ml of water, sufficient hydrochloric acid being added to form an emulsion having a pH of from 3.0 to 3.2. The weight of the emulsion was thereafter adjusted to 1000 g by adding water. The entire mixture was homogenised and formed a finely dispersed emulsion, which could be diluted with water to give opalexcent solutions.

Emulsion B

A polyethylene wax emulsion was prepared according to Example 1 of French Patent No. 1 570 231.

Using these emulsions, the following finishing bath solution is prepared.20 g/l of emulsion A, 40 g/l of emulsion B and 2 g/l of a conventional cationis 20% dibutyl tin maleate emulsion. Using the solution thus obtained, a polyamide fabric (weight per square meter about 75 g), a polyester-cotton fabric 35/65 (weight per square meter 133 g) and a polyamidecotton fabric 20/80 (weight per square meter 112 g) were impregnated, then squeezed to a weight increase of 65 to 75%, dried at 110° C. and condensed for 4 minutes at 150° C. The fabrics obtained had good water-repellency and good water-repellent effect. The finished fabrics had a soft and smooth handle.

EXAMPLE 5

Emulsion A 445 g of the solution prepared according to Example 1, Emulsion A, paragraph 2 of U.S. Pat. No. 3,320,197, were mixed with 95 g of water and 17.5 ml of 35% hydrochloric acid. Stirred at high speed into this solution was a solution at 280 g of methyl hydrogen polysiloxane (viscosity 30 cS at 20° C.) and 120 g of dimethyl polysiloxane (viscosity 750 cS at 20° C.) in 40 g of tetrachlorethylene and the pre-emulsion which is obtained was homogenised at 250 atm for 45 minutes on a high-pressure homogenising machine.

Emulsion B

Into 500 g of the aforementioned solution was incorporated by stirring at high speed a solution of 200 g of oxidised polyethylene (acid number 30, density at 20° C. 0.93 g/cc) in 300 g of tetrachlorethylene. The pre-emulsion which was obtained was homogenised at about 220 atm for about 40 minutes.

Emulsion C

The emulsions A and B were combined and again homogenised together for about 30 minutes at 250 atm.

For finishing a cotton fabric (weight per square meter 170 g), a bath solution was prepared which contained 40 g/l of the emulsion C and 2 g/l of the 20% dibutyl tin dilaurate emulsion used in previous examples. The fabric was impregnated with the solution, squeezed to a weight increase of about 70%, dried for a short time at 100° C. and condensed for 4 minutes at 155° C. The fabric thus treated has a very good water repulsion, a good water repellent effect and a pleasing soft handle.

I claim:

1. A process for making fibrous material water repellent, comprising the step of treating the fibrous material with an aqueous liquor which contains an emulsion of an organopolysiloxane, which contains hydrogen atoms bonded to silicon atoms, and an emulsion of oxidized polyethylene, wherein the dry weight ratio of organopolysiloxane to oxidized polyethylene is 100:3–152.

2. The process of claim 1, wherein the organopolysiloxane is a lower alkyl hydrogen polysiloxane.

3. The process according to claim 1 wherein the oxidized polyethylene is used as an aqueous emulsion with a non-ionic/ or a cationic emulsifier.

4. The process of claim 1, wherein the aqueous liquor contains 15 to 35 g/l of a 30 to 35% by weight emulsion of the organopolysiloxane and 20 to 50 g/l of a 10 to 20% by weight emulsion of the oxidized polyethylene.

5. The process according to claim 1, wherein the fibrous material is treated with the bath and squeezed to a weight increase of 50 to 75% based on the dry weight of fibrous material.

6. The process according to claim 1, wherein the oxidized polyethylene has an acid number of from 7 to 115.

7. The process according to claim 1, wherein the oxidized polyethylene has a density at 20° C. of 0.91 to 1.05 g/cc.

8. The fibrous material treated according to the process of claim 1.

* * * * *